US005116003A

United States Patent [19]

Gerhardt

[11] Patent Number: 5,116,003

[45] Date of Patent: May 26, 1992

[54] HANGER FOR ARTICLES OF DIFFERENT SIZES AND SHAPES

[76] Inventor: Karsten H. Gerhardt, 3520 Sweetwater Way, Lemon Grove, Calif. 92045

[21] Appl. No.: 619,090

[22] Filed: Nov. 26, 1990

[51] Int. Cl.[5] ..... A47K 1/08

[52] U.S. Cl. ..... 248/312; 248/313; 248/113

[58] Field of Search ..... 248/113, 539, 74.4, 248/110, 316.1, 316.5, 316.6, 312, 313; 232/41 E; 269/254 R; 211/89, 65, 66; 24/458, 489, 551, 552

[56] References Cited

U.S. PATENT DOCUMENTS 1,589,818 6/1926 Ritter ..... 248/113
1,644,539 10/1927 Minto ..... 248/312
2,616,647 11/1952 Murchison ..... 248/312
4,116,332 9/1978 Hartley ..... 248/65
4,909,467 3/1990 Shan-Pao ..... 248/313

*Primary Examiner*—Ramon O. Ramirez
*Assistant Examiner*—Robert A. Olson
*Attorney, Agent, or Firm*—John H. Crowe

[57] ABSTRACT

A hanger for articles of various sizes and shapes comprising a base on which are pivotally supported a pair of opposing article gripping members. The members are supported by the base for pivotal swinging movement about oppositely slanting axes to cause the members to converge into gripping engagement with an article when swinging downwardly under the action of gravity.

6 Claims, 1 Drawing Sheet

HANGER FOR ARTICLES OF DIFFERENT SIZES AND SHAPES

BACKGROUND OF THE INVENTION

1. Field of the Invention

This invention relates to article hangers and has particular reference to hangers for supporting and storing articles of various sizes and shapes such as brooms, shovels, books, individual papers, etc.

2. Background of the Invention

Hangers for supporting articles are well known in the arts. However, those of which I am aware present various drawbacks which leave much to be desired. For example, certain hangers provide spring-biased jaws which grip the sides of the article to support it. Although such hangers are satisfactory for holding articles of specified weights, they are incapable of supporting articles of heavier weights. Also, such jaws are frequently formed with serrated or roughened surfaces which tend to mar the surface of the article being supported.

Other hangers incorporate an article gripping member which is freely pivotal about a horizontal axis and has an opening therethrough to receive the article. The weight of the article causes the edges of the opening to grip it. Here, the leverage is such that the edges of the opening may mar the article's surface and, in cases where the article is made of relatively soft material such as aluminum or brass, the gripping action of the hanger thereon may be sufficiently strong to crush or otherwise damage it.

SUMMARY OF THE INVENTION

A principal object of the present invention is to provide an article hanger capable of safely supporting articles of various sizes and shapes.

Another object of the invention is to provide such an article hanger that will support an article of relatively fragile character without marring or damaging it.

Still another object of the invention is to provide such an article hanger that will automatically grip an article urged into mating contact therwith using only one hand.

Yet another object of the invention is to provide a hanger of the above type of simple, inexpensive construction and highly reliable character.

BRIEF DESCRIPTION OF THE DRAWING

The manner in which the above and other objects of the invention are accomplished will be readily understood from the following specification when read in conjunction with the accompanying drawing, wherein.

DESCRIPTION OF THE PREFERRED EMBODIMENT

Figure 1:
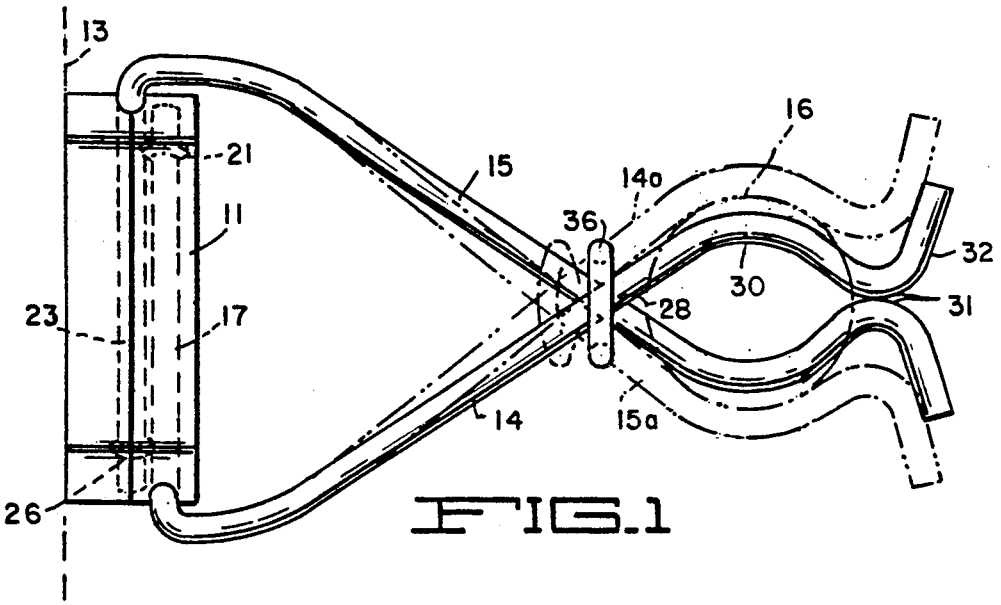
FIG. 1 is a top plan view of an embodiment of my improved article hanger.

While this invention may be embodied in different forms, I have disclosed herein a preferred embodiment. It is to be understood, however, that the present disclosure is intended to exemplify the principles of the invention and not limit it to that particular embodiment. The scope of the invention will be limited only by the language of the appended claims.

Considering now the drawing, the illustrated hanger comprises a base 11 of plastic or like material having holes 12 therein through which screws or other fastening elements (not shown) may be passed to secure it to the face of a vertical wall, such as shown by the dashed line 13.

Figure 4:
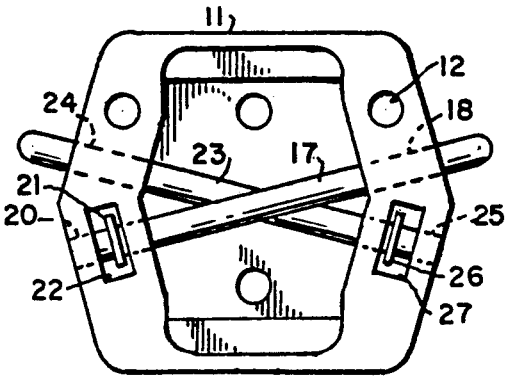
FIG. 4 is a rear elevational view of the hanger.

A pair of opposed gripping members 14 and 15 of somewhat similar character are provided to grip the sides of an article shown in phantom lines 16 as a vertically extending cylinder. Each of the gripping members 14 and 15 is formed from cylindrical rod stock of steel or other suitable material. Gripping member 14 is bent at one end at a substantially right angle to form an extension 17 which is pivotally supported in bearings 18 and 20 (FIG. 4) formed in the base 11. The extension 17 is retained in the bearings 18 and 20 by a retainer ring 21 secured thereto and confined in a slot 22 in the base sized to permit a limited amount of endwise movement of the extension.

Extension 17, it will be noted, is slanted at an acute ang to the horizontal.

The member 15 is similarly bent to form an extension 23 which is pivotally supported in bearings 24 and 25 in base 11. Extension 23 is retained in the bearings 24 and 25 by a second retainer ring 26 secured thereto and confined in a slot 27 in the base to permit a small endwise movement of the extension. Extension 23 is also slanted at an acute angle to the horizontal, but in an opposite direction to that of extension 17.

As viewed in FIG. 1, the members 14 and 15 converge and cross each other at 28 and are then met through an arc 30 to form an article-gripping portion. The members are then each bent reversely to form tips 31 and terminate in tails 32.

Figure 2:
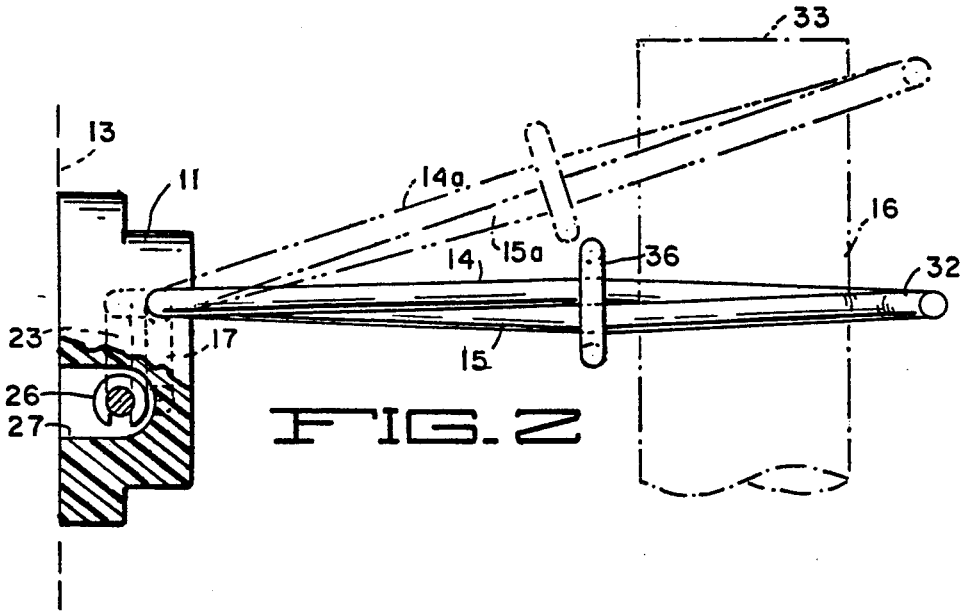
FIG. 2 is a side elevational view of the hanger, partly in section and illustrating in phantom lines an article being supported thereby.
Figure 3:
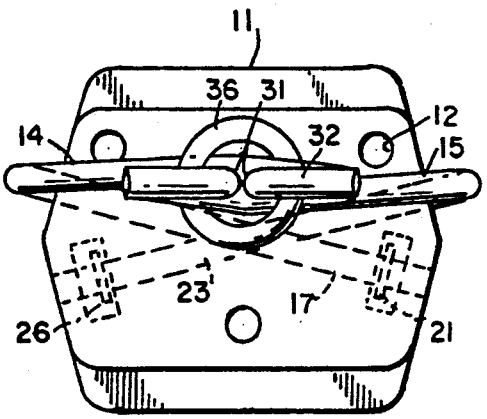
FIG. 3 is a front elevational view of the hanger, hidden parts being shown in dashed lines.

When no article is being gripped, gravity acts to swing the members 14 and 15 downwardly and, because of the previously noted slanted relation of the pivot extensions 17 and 23, the forward ends of the members will converge toward each other until the tips 31 abut, thus folding the members 14 and 15 in their full line illustrated positions shown in FIG. 1 and 2.

In order to mount an article, such as that depicted at 16, on the hanger, the article may be moved laterally against the tail portions 32 of the members causing them to separate and swing upwardly toward their dot-dash line positions **14*a* and 15*a***.

As the article 16 becomes seated in the gripping portions 30 of the members 14 and 15, and is then released, the members 14 and 15 will drop under the influence of gravity causing the gripping portions 30 to grip the sides of the article and thus hold it in the position shown by the phantom lines of FIG. 1 and 2.

Alternatively, the article 16 may be mounted in the hanger by merely raising its upper end 33 against the gripping members 14 and 15, thus rocking the members upwardly toward their open positions so that the article may be slipped between the gripping portions 30 and then released whereupon the members 14 and 15 will become effective to grip it.

In order to release the article 16 from the hanger, it can be merely raised slightly to release the gripping action of the hanger thereon and then withdrawn laterally past the tips 31. At this time, the gripping members will again drop and consequently converge until the tips 31 engage each other to fix the members in their normal horizontally extending positions.

The retainer rings 21 and 26 are permitted a small axial movement in their respective slots 22 and 27 to prevent any binding of the gripping members 14 and 15 in their swinging movements.

Articles of shapes other than cylindrical, such as books, boards and even sheets of paper or the like may also be supported by the present hanger. In such case, the article may be merely inserted between tips 31 and then released, enabling the gripping action to take place between the tips and the article being supported.

To insure that the gripping members 14 and 15 swing up and down in unison, an annular ring 36 is loosely fitted around the members 14 and 15 at their crossover point 28. Thus as the members 14 and 15 converge and diverge due to their vertical swinging movement, the ring 36 will merely move along the members but always position itself at this crossover point. As FIG. 2 shows, members 14 and 15 are oppositely curved intermediate their ends in the vertical direction, as illustrated in FIG. 2, to insure horizontal alignment of their tips 31 in their full line positions in that figure.

From the foregoing, it will be seen that I have, in the present invention, provided an inexpensive and compact article hanger which will firmly and reliably support articles of various sizes and shapes.

I claim:

1. A hanger for articles comprising:

a base, a pair of elongate article gripping members, and means on said base pivotally supporting these members at one end of each for swinging movement about respective axes oppositely inclined relative to each other and to the horizontal, each of said members having an article gripping portion between its opposite end and its pivotal supporting means, and said members crossing each other at a point intermediate their pivotal supporting means and their gripping portions, whereby swinging of said members about respective ones of said axes under the influence of gravity causes their gripping portions to converge toward each other and to grip an article positioned therebetween.

2. A hanger for articles comprising:

a base, a pair of elongate article gripping members, and means on said base pivotally supporting these members at one end of each for swinging movement about respective axes oppositely inclined relative to each other and to the horizontal, each of said members having an article gripping portion between its opposite end and its pivotal supporting means, said article gripping portion being concentrically curved to at least substantially fit the surface of a cylindrical article to be gripped thereby and each article gripping member having a convexly curved portion to engage the surface of a noncylindrical article to be gripped thereby, whereby swinging of said members about respective ones of said axes under the influence of gravity causes their gripping portions to converge toward each other and to grip an article positioned therebetween.

3. A hanger as set forth in claim 2 wherein the convexly curved portions of the gripping members are positioned to meet and limit downward swinging movement of said gripping members.

4. A hanger as set forth in claim 3 in which said gripping members are oppositely curved in a way to give them clearance to cross and permit said convexly curved portions to meet and limit said downward swinging movement of said gripping members.

5. A hanger for articles comprising:

a base, and a pair of elongate article gripping members, means on said base pivotally supporting these members at one end of each for swinging movement about respective axes oppositely inclined relative to each other and to the horizontal, each of said members having an article gripping portion between its opposite end and its pivotal supporting means, and said hanger including guide means for causing said gripping members to swing in unison with each other, whereby swinging of said members about respective ones of said axes under the influence of gravity causes their gripping portions to converge toward each other and to grip an article positioned therebetween.

6. A hanger as set forth in claim 5 in which said guide means comprises an annular member surrounding said gripping members and slidable therealong as said gripping portions are pivoted vertically in use.

* * * * *

US005116003B1

REEXAMINATION CERTIFICATE (3176th)

United States Patent [19] [11] B1 5,116,003

Gerhardt [45] Certificate Issued Apr. 15, 1997

[54] HANGER FOR ARTICLES OF DIFFERENT SIZES AND SHAPES

[75] Inventor: Karsten H. Gerhardt, Lemon Grove, Calif.

[73] Assignee: Ultra-Hold Corporation, Quebec, Canada

Reexamination Request:
No. 90/004,064, Dec. 7, 1995

Reexamination Certificate for:

| | |
|---|---|
| Patent No.: | **5,116,003** |
| Issued: | **May 26, 1992** |
| Appl. No.: | **619,090** |
| Filed: | **Nov. 26, 1990** |

[51] Int. Cl.[6] ..... A47K 1/08
[52] U.S. Cl. ..... 248/312; 248/113; 248/313
[58] Field of Search ..... 248/113, 539, 248/74.4, 110, 316.1, 316.5, 316.6, 312, 313; 232/41 E; 269/254 R; 211/89, 65, 66; 24/458, 489, 551, 552

[56] References Cited

U.S. PATENT DOCUMENTS 1,246,492 11/1917 Thiele ..... 248/113
5,322,256 6/1994 Kanwischer .

FOREIGN PATENT DOCUMENTS 0180884 5/1986 European Pat. Off. .
8432710 1/1985 Germany .

*Primary Examiner*—Ramon O. Ramirez

[57] ABSTRACT

A hanger for articles of various sizes and shapes comprising a base on which are pivotally supported a pair of opposing article gripping members. The members are supported by the base for pivotal swinging movement about oppositely slanting axes to cause the members to converge into gripping engagement with an article when swinging downwardly under the action of gravity.

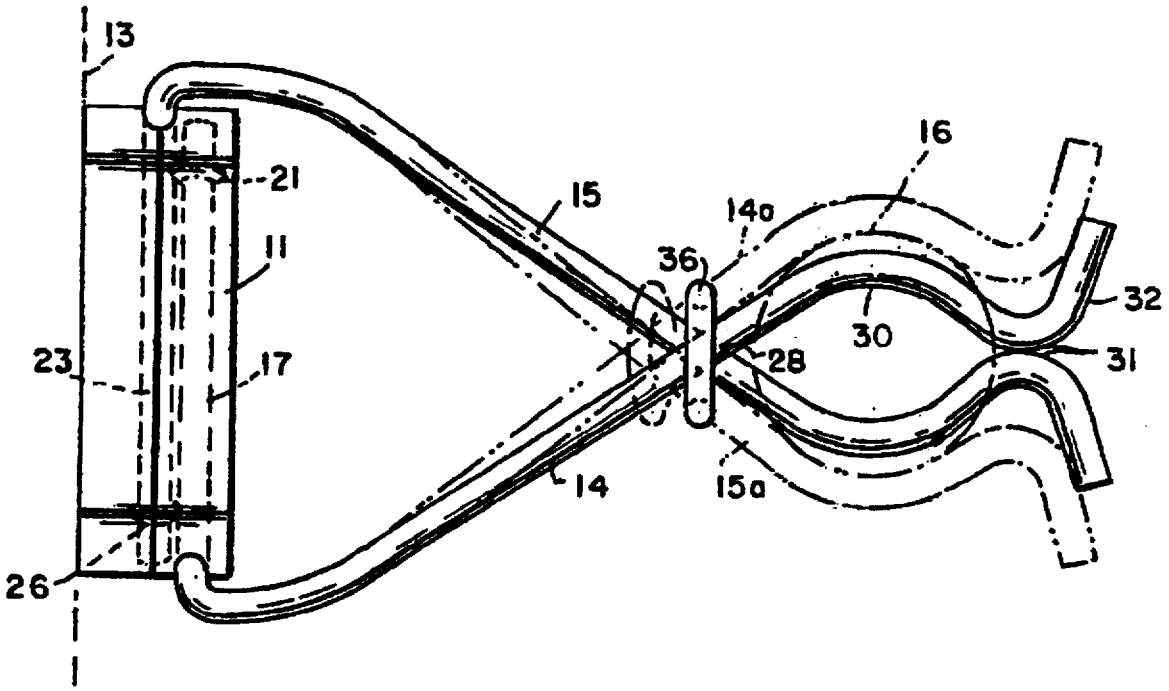

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5 and 6 are cancelled.

Claim 2 is determined to be patentable as amended.

Claims 3 and 4, dependent on an amended claim, are determined to be patentable.

New claims 7 and 8 are added and determined to be patentable.

2. A hanger for articles comprising:

a base, a pair of elongate article gripping members,

*wherein said base comprises an integral open box member having a substantially open wall-facing side exposing a cavity receiving said one end of said gripping members, said box member having a peripheral wall engaging lip and an outwardly facing substantially flat closed front side, said wall engaging lip comprising an upper and a lower horizontal portion projecting beyond upper and lower side walls of said box member, respectively, said upper and lower horizontal portions extending substantially across the entire width of said upper and lower side walls, respectively,* and means on said base pivotally supporting these members at one end of each for swinging movement about respective axes oppositely inclined relative to each other and to the horizontal, each of said members having an article gripping portion between its opposite end and its pivotal supporting means, said article gripping portion being concentrically curved to at least substantially fit the surface of a cylindrical article to be gripped thereby and each article gripping member having a convexly curved portion to engage the surface of a noncylindrical article to be gripped thereby, *and said members crossing each other at a point intermediate their pivotal supporting means and their gripping portions,* whereby swinging of said members about respective ones of said axes under the influence of gravity causes their gripping portions to converge toward each other and to grip an article positioned therebetween.

*7. The hanger as claimed in claim 2, wherein lateral side walls of said box member have upper portions angled inwardly through which said gripping members are pivotally inserted, said upper portions being substantially perpendicular to said respective axes of said gripping members.*

*8. A hanger for articles comprising:*

*a base,*

*a pair of elongate article gripping members, and*

*means on said base pivotally supporting these members at one end of each for swinging movement about respective axes oppositely inclined relative to each other and to the horizontal,*

*said one end of each of said pair of gripping members being provided with retainer means for preventing said gripping members from sliding out of said base,*

*each of said members having an article gripping portion between its opposite end and its pivotal supporting means, and said members crossing each other at a point intermediate their pivotal supporting means and their gripping portions,*

*whereby swinging of said members about respective ones of said axes under the influence of gravity causes their gripping portions to converge toward each other and to grip an article positioned therebetween,*

*wherein said base comprises an open box member having a substantially open wall-facing side exposing a cavity receiving said one end of said gripping members, said box member having a peripheral wall engaging lip and an outwardly facing closed substantially flat front side,*

*wherein said one end of each of the elongate article gripping members that is pivotally supported in the base terminates within the open box member, and*

*wherein lateral side walls of said box member have upper portions angled inwardly through which said gripping members are pivotally inserted, said upper portions being substantially perpendicular to said respective axes of said gripping members.*

* * * * *